US008978402B2

(12) United States Patent
Itagaki et al.

(10) Patent No.: US 8,978,402 B2
(45) Date of Patent: Mar. 17, 2015

(54) HEAT PUMP APPARATUS

(75) Inventors: Atsushi Itagaki, Kawasaki (JP); Takashi Sugiyama, Kawasaki (JP); Toshiyuki Fuji, Kawasaki (JP); Hiroshi Abiko, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 746 days.

(21) Appl. No.: 12/890,199

(22) Filed: Sep. 24, 2010

(65) Prior Publication Data

US 2011/0072839 A1 Mar. 31, 2011

(30) Foreign Application Priority Data

Sep. 28, 2009 (JP) ..... 2009-222184

(51) Int. Cl.
*F25B 41/04* (2006.01)
*F25B 30/02* (2006.01)
*F25B 49/02* (2006.01)

(52) U.S. Cl.
CPC ..... *F25B 30/02* (2013.01); *F25B 49/02* (2013.01); *F25B 2339/047* (2013.01);
(Continued)

(58) Field of Classification Search
CPC .... F25B 30/02; F25B 49/02; F25B 2339/047; F25B 2600/21; F25B 2600/2513; F25B 2700/21174; F25B 2700/171; F25B 2700/1931; F25B 2700/21161
USPC ..... 62/206, 222, 225
See application file for complete search history.

(56) References Cited

U.S. PATENT DOCUMENTS 4,787,213 A 11/1988 Gras et al.
5,115,644 A * 5/1992 Alsenz ..... 62/181
(Continued)

FOREIGN PATENT DOCUMENTS

EP 0 229 942 A2 7/1987
EP 692683 A2 * 1/1996 ..... F24F 11/00
(Continued)

OTHER PUBLICATIONS

English Machine Translation for JP2005-140431.*
(Continued)

*Primary Examiner* — Marc Norman
*Assistant Examiner* — Paolo Gonzalez
(74) *Attorney, Agent, or Firm* — Venable LLP; Michael A. Sartori; Tamatane J. Aga

(57) ABSTRACT

A heat pump apparatus includes: a refrigerant circuit which includes a compressor, a utilization-side heat exchanger for exchanging heat between water and refrigerant, an electronic expansion valve, and an outdoor heat exchanger; a controller which controls the compressor and the electronic expansion valve; a subcooling value calculating unit which calculates a subcooling value of the refrigerant circuit; a condensing pressure detector which detects condensing pressure of the compressor; a compressor rotation number detector which detects rotation number of the compressor; and an objective subcooling value extracting unit which selects and extracting an objective subcooling value stored in advance, from the condensing pressure and the rotation number of the compressor. The controller adjusts an opening degree of the electronic expansion valve so that the calculated subcooling value of the refrigerant circuit reaches the objective subcooling value.

2 Claims, 7 Drawing Sheets

(52) U.S. Cl.
CPC .... *F25B 2600/21* (2013.01); *F25B 2600/2513* (2013.01); *F25B 2700/171* (2013.01); *F25B 2700/1931* (2013.01); *F25B 2700/21161* (2013.01); *F25B 2700/21174* (2013.01)
USPC ..... 62/222; 62/225; 62/226

(56) References Cited

U.S. PATENT DOCUMENTS

| | | | | |
|---|---|---|---|---|
| 5,651,263 | A * | 7/1997 | Nonaka et al. | 62/205 |
| 5,701,753 | A | 12/1997 | Iritani | |
| 5,987,903 | A * | 11/1999 | Bathla | 62/129 |
| 6,351,950 | B1 * | 3/2002 | Duncan | 62/3.2 |
| 7,415,838 | B2 * | 8/2008 | Park et al. | 62/434 |
| 2002/0129615 | A1 | 9/2002 | Ma et al. | |
| 2008/0229770 | A1 * | 9/2008 | Liu | 62/225 |
| 2009/0249827 | A1 * | 10/2009 | Ujiie et al. | 62/509 |
| 2011/0023515 | A1 * | 2/2011 | Kopko et al. | 62/222 |

FOREIGN PATENT DOCUMENTS

| | | | |
|---|---|---|---|
| EP | 1 972 871 | A2 | 9/2008 |
| EP | 2096377 | A1 * | 9/2009 |
| JP | 1 057054 | A | 3/1989 |
| JP | 03-217767 | | 9/1991 |
| JP | 04-363552 | A | 12/1992 |
| JP | 08-028985 | A | 2/1996 |
| JP | 2002-081767 | A | 3/2002 |
| JP | 2004-012127 | A | 1/2004 |
| JP | 2005-140431 | A | 6/2005 |
| JP | 2005 156030 | A | 6/2005 |
| JP | 2006-200843 | A | 8/2006 |

OTHER PUBLICATIONS

Notification of Reasons for Refusal in Japanese Patent Application No. 2009-222184, mailing date of Dec. 11, 2012.
Office Action in Chinese Patent Application No. 201010294588.8, dated Mar. 25, 2013.

* cited by examiner

FIG. 10

| STATE OF CONDENSING PRESSURE | | RISING | DROPPING | RISING | DROPPING | RISING | DROPPING |
|---|---|---|---|---|---|---|---|
| THRESHOLD VALUE OF CONDENSING PRESSURE (MPaG) | | LESS THAN 3.0 | LESS THAN 2.8 | 3.0 to 3.6 | 2.8 to 3.4 | MORE THAN 3.6 | MORE THAN 3.4 |
| ROTATION NUMBER (rps) | MORE THAN 70 | 12°C | | 10°C | | 7°C | |
| | 40 TO 70 | 10°C | | 8°C | | 6°C | |
| | LESS THAN 40 | 6°C | | 5°C | | 4°C | |

HEAT PUMP APPARATUS

This application claims priority from Japanese Patent Application No. 2009-222184, filed on Sep. 28, 2009, the entire contents of which are hereby incorporated by reference.

FIELD OF THE INVENTION

The present invention relates to a heat pump apparatus such as a heat pump type floor heater, a water heater, etc., and more particularly, to efficient control in operating a refrigerant circuit for converting water into hot water by heat exchange, which is suitable for generating the hot water.

DESCRIPTION OF RELATED ART

An air conditioner is a typical apparatus as a heat pump apparatus. In order to efficiently perform heating operation of the air conditioner, Japanese Patent Application Publication No. JP-A-H03-217767 discloses a method of controlling a supercooling degree (subcooling value) in a refrigeration cycle. In the following description, the subcooling value is called as SC value.

JP-A-H03-217767 discloses a related-art refrigerant circuit of heat pump type in which a compressor, a condenser, an electronic expansion valve, and an evaporator are sequentially connected by piping. In the related-art refrigerant circuit, the condenser is provided with a condensing temperature detector for detecting temperature of the refrigerant in the condenser, and a discharging temperature detector for detecting temperature of the refrigerant at an outlet of the condenser. A control part for controlling this refrigerant circuit calculates the supercooling degree from the temperature of the refrigerant which is detected by the condensing temperature detector and the discharging temperature detector, and controls an opening degree of the electronic expansion valve so that the result of the calculation may reach an objective value.

Moreover, the control part controls the opening degree of the electronic expansion valve so that the objective supercooling degree may be lowered by a determined amount, at every time when the temperature detected by the condensing temperature detector or the discharging temperature of the refrigerant in the compressor exceeds a determined limit value. In this manner, deterioration of operation efficiency can be restrained and stabilized operation can be effected.

On the other hand, in the heat pump type floor heater which is an example of the heat pump apparatus, the heat exchange is effected using water which circulates in a floor heating panel, and there is a big difference from the air conditioner in which a heat exchanger of an indoor unit uses air as an object of the heat exchange. However, because the refrigerant circuits in both cases have substantially the same structure, an outdoor unit of the air conditioner is sometimes used commonly as an outdoor unit of the heat pump type floor heater. Therefore, the same method has been adopted for controlling the SC value, in some cases.

However, in respect of relation between the supercooling degree and Coefficient of Performance (COP), when the SC value changes, the COP varies at a larger rate in the heat pump type floor heater, as compared with the air conditioner. Therefore, unless the SC value is strictly controlled, the COP is deteriorated, and inefficient operation may be incurred, in some cases.

This relation between the supercooling degree and COP will be described below by comparing the air conditioner and the conventional heat pump type floor heater, referring to a graph of SUBCOOL-COP characteristic in FIG. 2. The graphs and data values in FIGS. 2 to 10 are those values which have been obtained by experiments or those values which have been determined on the basis of these values.

FIG. 2 is a graph showing the relation between the SC value (supercooling degree) and COP, when the heat pump type floor heater is compared with the air conditioner, in case where the outdoor temperature is 7° C. As shown in FIG. 2, it is found that in the related-art heat pump type floor heater, a change of the SC value exerts a larger influence on the COP, as compared with the air conditioner.

In FIG. 2, an X-axis of the graph represents the SC value (unit: ° C.) at the outlet of the heat exchanger, and a Y-axis of the graph represents a ratio to the highest COP at that time, respectively in case of the heat pump type floor heater and in case of the air conditioner. In FIG. 2, the higher the COP is, the more efficient operation can be realized, and hence, the SC value at which the high ratio to the highest COP can be maintained is a target of the operation. "The ratio to the highest COP" means the ratio to the highest value of the COP which is measured in each of the apparatuses.

For example, in the heat pump type floor heater, when the COP is the highest (the ratio to the highest COP: 1.0), the SC value is 5.0° C., and on the other hand, when the COP is the lowest (the ratio to the highest COP: 0.87), the SC value is 10.9° C., which is lower by 13% than the case where the COP is the highest.

This means that there is such possibility that deterioration of efficiency to this extent may occur, in case where the heat pump type floor heater is controlled in the method of controlling the compressor 1 and the opening degree of the electronic expansion value 4 so as to obtain the objective discharging temperature to be determined according to the water temperature which is detected by the discharging hot water temperature sensor 12, and the SC value is left as it goes. The SC value when the COP is the highest under particular operation conditions is called as the optimal SC of the relevant operation.

On the other hand, in the air conditioner, when the COP is the highest (the ratio to the highest COP: 1.0), the SC value is 8.4° C., and on the contrary, when the COP is the lowest (the ratio to the highest COP: 0.977), the SC value is 16.2° C., which is lower by 2.3% than the case where the COP is the highest.

This means that in case of the air conditioner, the efficiency is deteriorated only by about 2.3% at the largest, even though particular subcooling control is not conducted. Therefore, in the heat pump type floor heater, the coefficient of performance may be deteriorated, unless delicate subcooling control is conducted, as compared with the air conditioner.

Such difference in characteristic between the heat pump type cycle apparatus and the air conditioner occurs, because an object of the heat exchange with the refrigerant is different from each other. Specifically, the water is the object of the heat exchange in the heat pump apparatus, and the air is the object of the heat exchange in the air conditioner. Because heat conductivity of the water is higher than heat conductivity of the air, the heat exchanger for the water can be designed to be more compact. This is because a short passage is enough to exchange heat between the water and the refrigerant, in the heat exchanger for the water.

For this reason, as compared with the heat exchanger for the air having the same ability, the heat exchanger for the water has a smaller capacity in the pipe for the refrigerant inside the heat exchanger, and a subcooling range having the high COP is made smaller. Accordingly, it is necessary to delicately control the refrigerant, in the heat pump apparatus.

SUMMARY OF INVENTION

Illustrative aspects of the present invention provide a heat pump apparatus of which operation efficiency is enhanced, by conducting subcooling control according to various operation conditions.

According to a first aspect of the invention, a heat pump apparatus is provided with: a refrigerant circuit which includes a compressor, a utilization-side heat exchanger for exchanging heat between water and refrigerant, an electronic expansion valve, and an outdoor heat exchanger; a controller which controls the compressor and the electronic expansion valve; a subcooling value calculating unit which calculates a subcooling value of the refrigerant circuit; a condensing pressure detector which detects condensing pressure of the compressor; a compressor rotation number detector which detects rotation number of the compressor; and an objective subcooling value extracting unit which selects and extracting an objective subcooling value stored in advance, from the condensing pressure and the rotation number of the compressor, wherein the controller adjusts an opening degree of the electronic expansion valve so that the calculated subcooling value of the refrigerant circuit reaches the objective subcooling value.

Other aspects and advantages of the invention will be apparent from the following description, the drawings and the claims.

BRIEF DESCRIPTION OF THE DRAWINGS

FIG. 10 is an explanatory view showing an objective subcooling table (hereinafter, objective SC table) in which the condensing pressure, the rotation number of the compressor, and the objective SC value are itemized in the table.

DETAILED DESCRIPTION OF EXEMPLARY EMBODIMENTS

Now, a mode for carrying out the invention will be described by way of an exemplary embodiment of the invention, referring to FIGS. 1 to 10.

Figure 1:
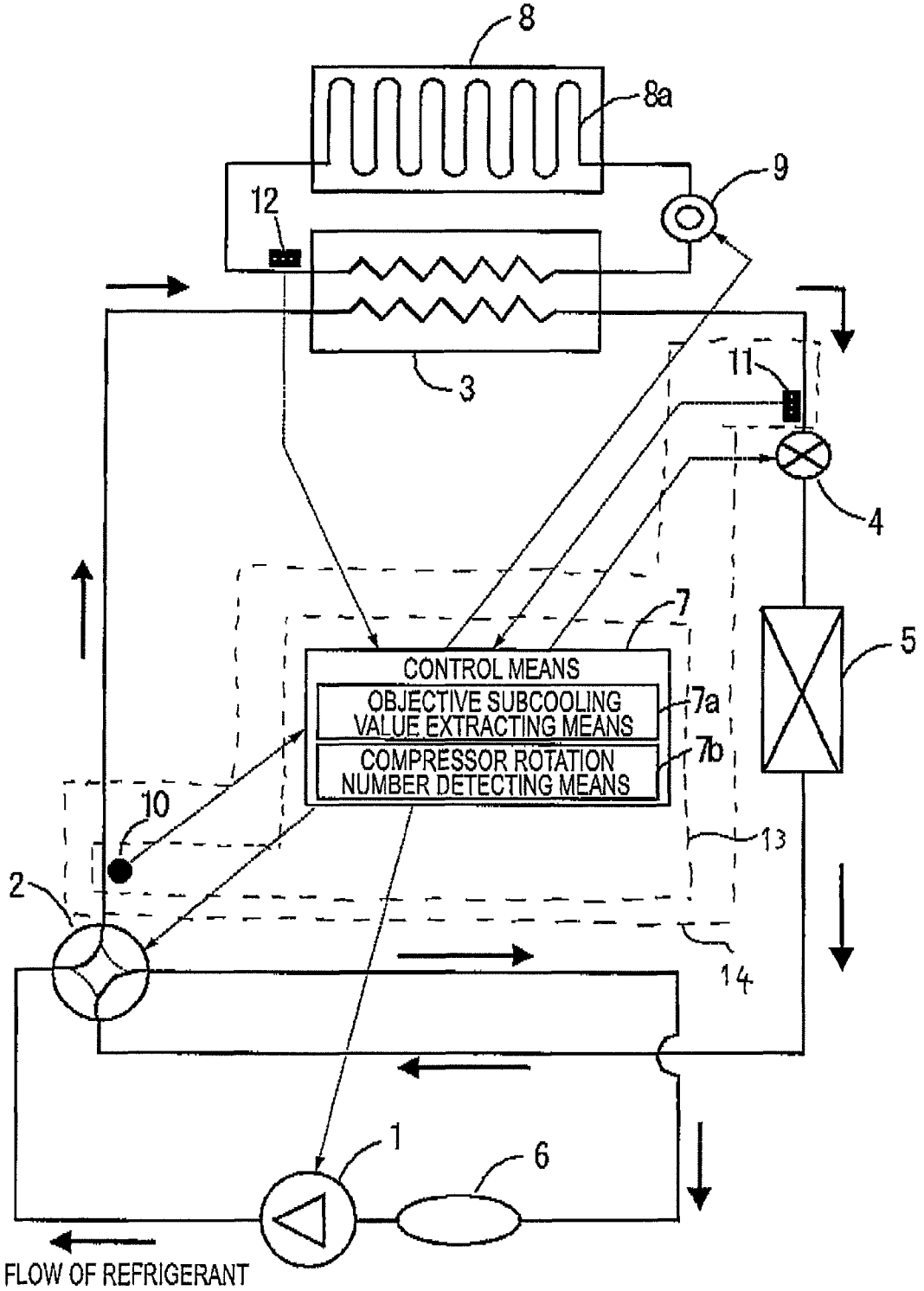
FIG. 1 is a diagram showing a refrigerant circuit of a heat pump apparatus according to an exemplary embodiment of the invention.
Figure 2:
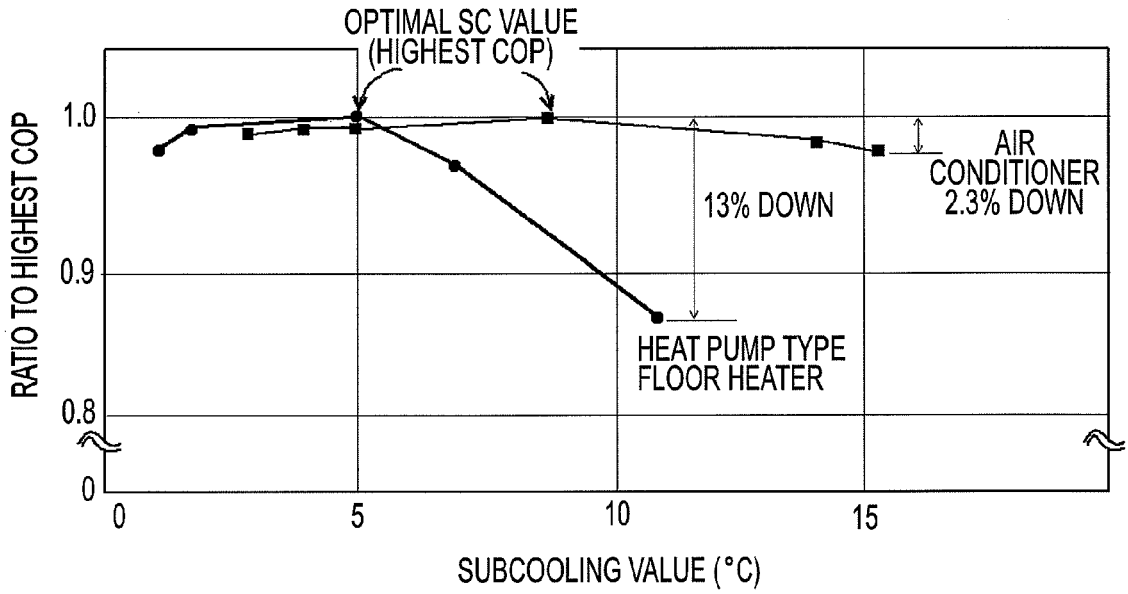
FIG. 2 is a graph showing a relationship between SC value and COP.

FIG. 1 is a diagram showing a refrigerant circuit in the heat pump apparatus according to the exemplary embodiment.

In the refrigerant circuit of the heat pump apparatus according to the exemplary embodiment, a compressor 1, a four way valve 2, an utilization-side heat exchanger 3 for exchanging heat between the refrigerant and water, an electronic expansion valve 4, an outdoor heat exchanger 5, and an accumulator 6 are sequentially connected, and the refrigerant circuit is so constructed that a direction of circulating the refrigerant may be converted, by switching the four way valve 2. Moreover, a pressure sensor 10 for detecting a discharging pressure is provided at a discharge side of the compressor 1, and a refrigerant temperature sensor 11 for detecting temperature of the refrigerant in vicinity of the electronic expansion valve 4 is provided between the utilization-side heat exchanger 3 and the electronic expansion valve 4.

On the other hand, in the utilization-side heat exchanger 3, the water after the heat exchange with the refrigerant is circulated, and a circulation path is formed by sequentially connecting the utilization-side heat exchanger 3, a floor heating panel 8 containing therein a meandering pipe 8*a*, and a pump 9 for hot water. Moreover, a discharging hot water temperature sensor 12 for detecting temperature of discharging hot water is provided at an outlet for the water of the utilization-side heat exchanger 3 in the circulating path.

In addition, there are provided control means 7 for actuating and controlling the compressor 1, the four way valve 2, the pump 9, and the electronic expansion valve 4, according to a value which has been detected by the pressure sensor 10, the discharging hot water temperature sensor 12, and the refrigerant temperature sensor 11. Then, the controls to be executed by the control means 7 will be described.

In the heat pump type floor heater, when the operation is started, the control means 7 rotates the pump 9, and circulates the water between the utilization-side heat exchanger 3 and the floor heating panel 8.

The refrigerant which has become gas having high temperature and high pressure passes the four way valve 2, and discharges heat by the utilization-side heat exchanger 3 to be liquidized. Then, the liquidized refrigerant is reduced in pressure by the electronic expansion valve 4, vaporized by the outdoor heat exchanger 5 to exchange heat with an outdoor air, thereby to be gasified, and again, compressed by the compressor 1. The above process is repeated. The four way valve 2 is used for reversing the direction of circulating the refrigerant during defrosting operation.

Programs for conducting the controls proper to the exemplary embodiment are stored in a microcomputer which is incorporated in the control means 7, and the following controls and various means will be realized by operating this microcomputer according to the programs.

In FIG. 1, SC value calculating means 14 for calculating the SC value of the refrigerant circuit is composed of the control means 7, the pressure sensor 10, and the refrigerant temperature sensor 11. Moreover, condensing pressure detecting means 13 for detecting a discharging pressure and using it as a condensing pressure is composed of the control means 7 and the pressure sensor 10. Further, the control means 7 includes therein compressor rotation number detecting means 7*b* for extracting the current rotation number from rotation number control data of the compressor 1 which is controlled by the control means 7, and objective SC value extracting means 7*a* for obtaining the objective SC value from the condensing pressure and the rotation number of the compressor 1. These means will be described in detail, hereunder.

Embodiment 1

First, for the purpose of controlling the SC value according to various operation conditions, characteristic of the optimal SC value which varies according to the respective operation conditions will be described. The graphs and the data therein are those which have been experimentally measured, and are different depending on measuring conditions, such as the respective types of the apparatus, pipe lengths for the refrigerant, and so on. An object of this invention is to extract characteristics of the heat pump apparatus from the experimental data which are detected by varying these measuring conditions, to grasp its tendency, and to enhance the COP by applying the tendency to actual control of the apparatus.

Figure 3:
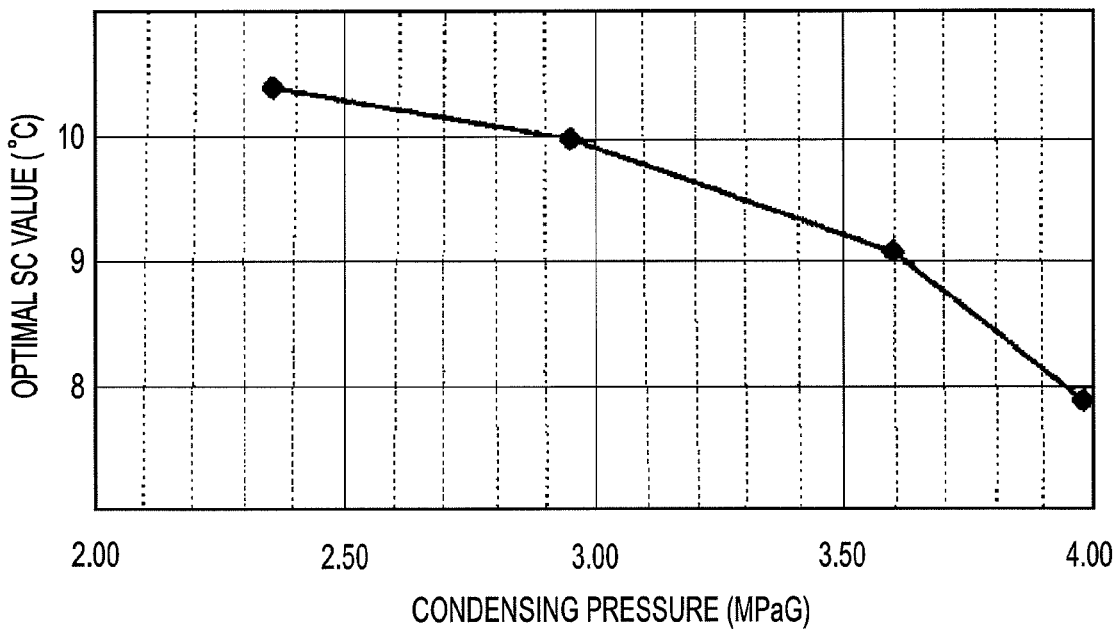
FIG. 3 is a graph showing a relationship between condensing pressure and the optimal SC value.

FIG. 3 is a graph showing relation between the condensing pressure and the optimal SC value, in which an X-axis represents the condensing pressure (unit: MPaG, mega-pascal gauge pressure), and a Y-axis represents the optimal SC value (unit: ° C.). Because the condensing pressure is substantially the same as the pressure which is detected by the pressure sensor 10 in FIG. 1, they are treated as the same in the exemplary embodiment. Accordingly, the discharging pressure is shown as the condensing pressure. Moreover, the optimal SC value represents a change of the optimal SC value caused by a change of the condensing pressure, in case where the rotation number of the compressor 1 is fixed at 65 rps (rotation per second) at an outdoor air temperature of 7° C. In case where the rotation number of the compressor 1 is fixed, an opening degree of the electronic expansion valve 4 is also fixed in association. The change of the optimal SC value of the condensing pressure in this case is influenced by the temperature of the water which circulates to the utilization-side heat exchanger 3 as a load.

As shown in FIG. 3, as the condensing pressure increases, the optimal SC value tends to be gradually lowered. Therefore, in the actual control of a refrigeration cycle, when the condensing pressure which is detected by the pressure sensor 10 increases by a certain amount, it is necessary to decrease the objective SC value, that is, the optimal SC value, by a certain amount.

Figure 4:
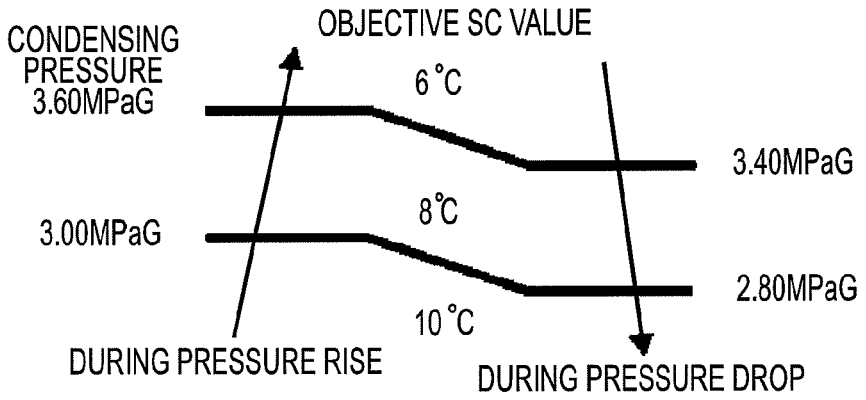
FIG. 4 is an explanatory view showing a relationship between the condensing pressure and an objective SC value.

This concept is schematically shown in FIG. 4 of an explanatory view showing relation between the condensing pressure and the objective SC value. In FIG. 4, the condensing pressure is divided into three zones, and the objective SC values are set in the respective zones. For the purpose of decreasing hunting in the control, hysteresis is formed in threshold values of the zones according to a rise or a drop of the condensing pressure.

Specifically, during a rising tendency of the pressure, the condensing pressure is divided into a zone less than 3.00 MPaG, a zone from 3.00 MPaG to 3.60 MPaG, and a zone more than 3.60 MPaG, and the objective SC values are respectively set to be 10° C., 8° C. and 6° C., in order from the zone having the smaller pressure. On the contrary, during a dropping tendency of the pressure, the condensing pressure is divided into a zone less than 2.80 MPaG, a zone from 2.80 MPaG to 3.40 MPaG, and a zone more than 3.40 MPaG, and the objective SC values are respectively set to be 10° C., 8° C. and 6° C., in order from the zone having the smaller pressure. In this manner, even if the condensing pressure changes, the objective SC value is converted correspondingly. Therefore, it is possible to maintain the high COP, even if the condensing pressure changes.

Figure 5:
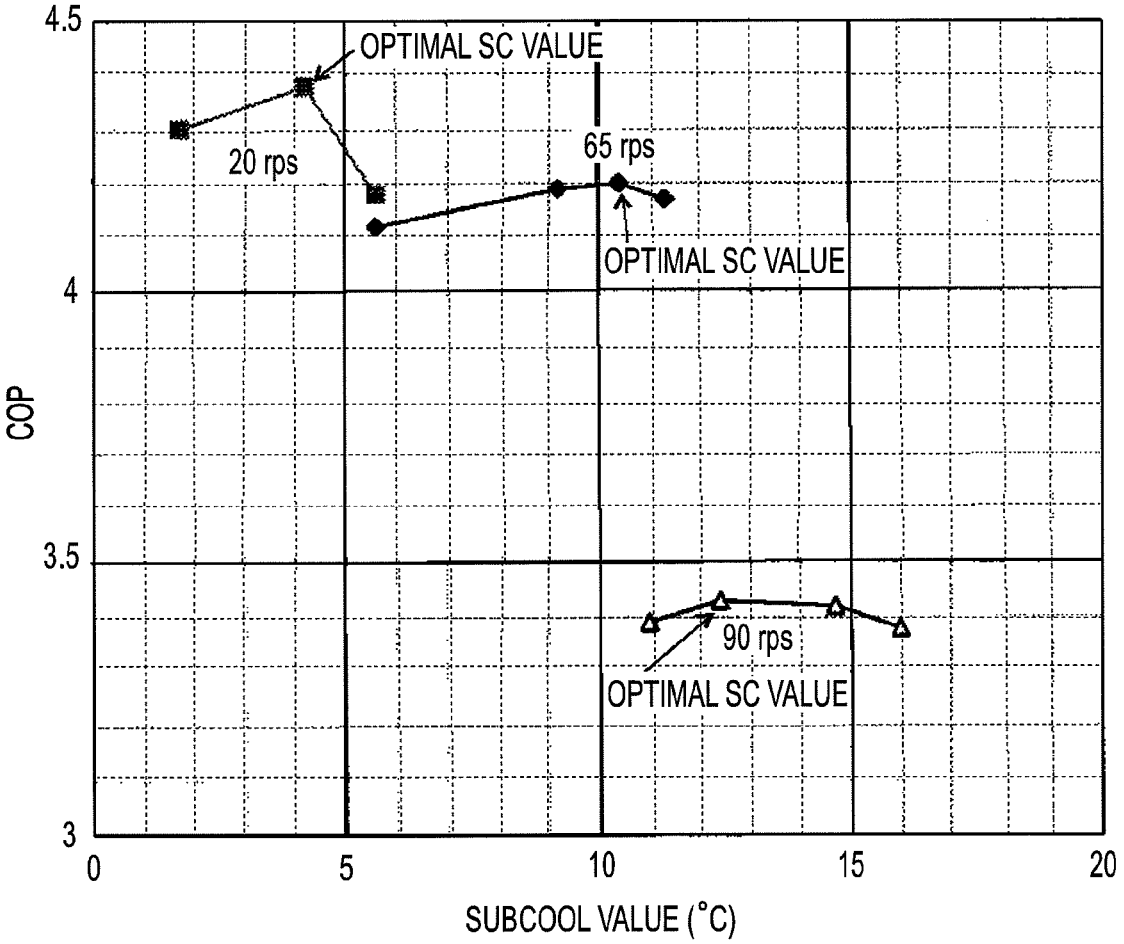
FIG. 5 is a graph showing a relationship between the SC value and the COP with respect to change of rotation number of a compressor.

FIG. 5 is a graph of the SC-COP characteristics showing a relationship between the SC value and the COP with respect to the rotation number of the compressor 1. In FIG. 5, a Y axis represents the COP, and an X-axis represents the SC value (unit: ° C.). The SC-COP characteristics are respectively shown in case where the rotation number of the compressor 1 is 20 rps, 65 rps, and 90 rps.

As shown in FIG. 5, there are points where the highest COPs are shown at the respective rotation numbers. At the rotation number of 20 rps, a peak of the COP is 4.38 when the SC value is 4.2° C., at the rotation number of 65 rps, a peak of the COP is 4.20 when the SC value is 10.5° C., and at the rotation number of 90 rps, a peak of the COP is 3.42 when the SC value is 12.3° C. These peaks of the respective COPs are the optimal SC values at the respective rotation numbers.

Figure 6:
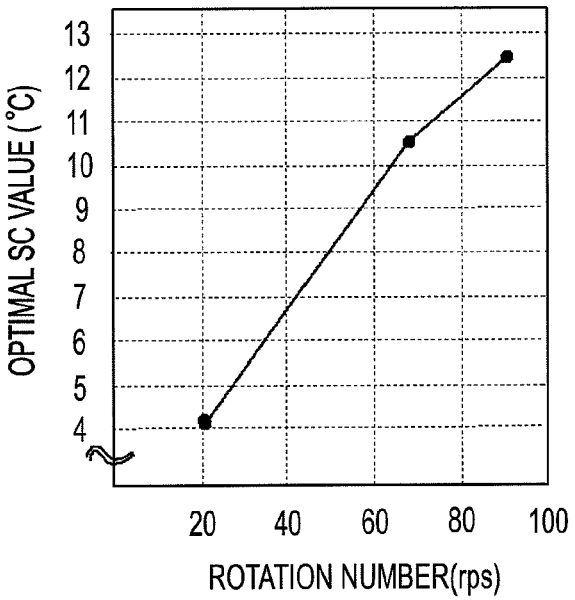
FIG. 6 is a graph showing a relationship between the optimal SC value and the rotation number of the compressor.

FIG. 6 is a graph showing relation between the optimal SC value and the rotation number of the compressor. In FIG. 6, a Y-axis represents the optimal SC value (unit: ° C.) at the respective rotation numbers in FIG. 5, and an X-axis represents the rotation number (rps) of the compressor. As shown in FIG. 6, as the rotation number of the compressor increases, the optimal SC value also increases substantially rectilinearly.

Figure 7:
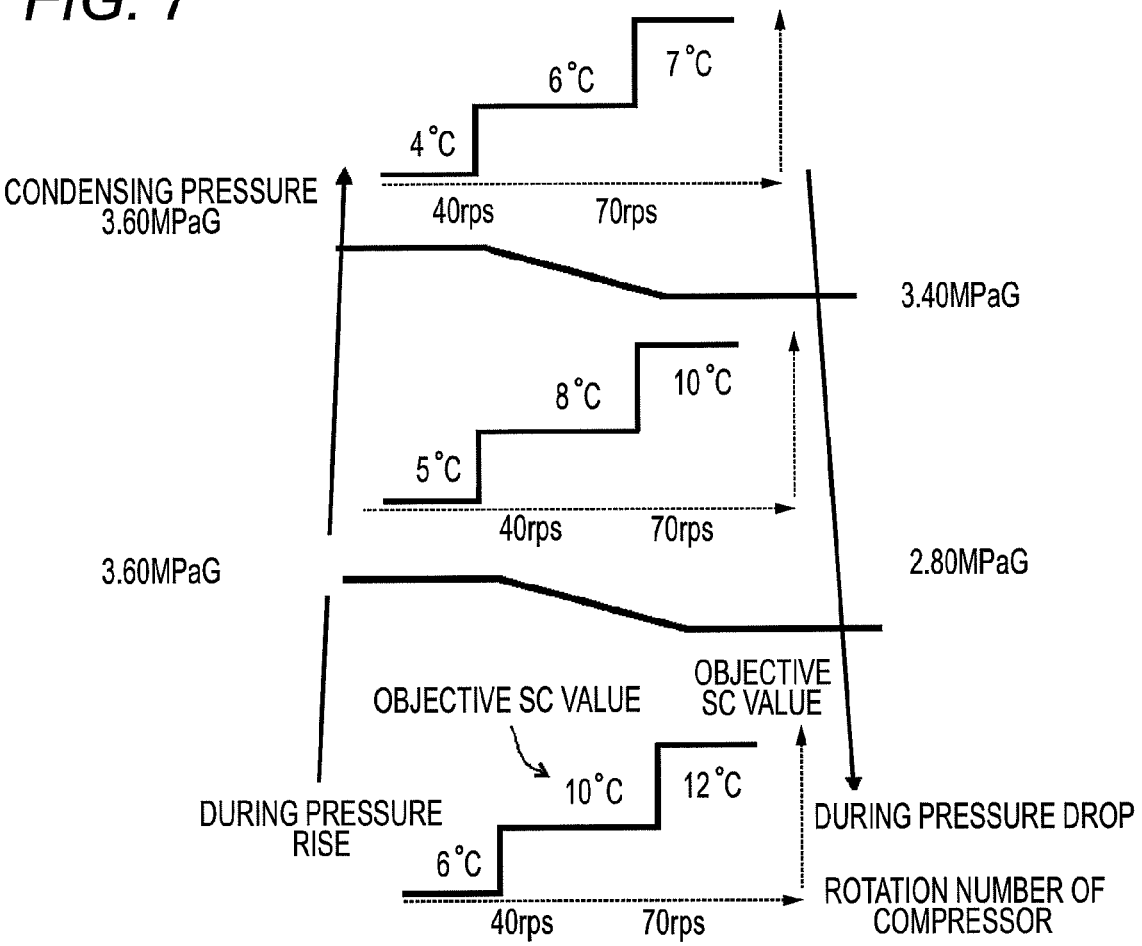
FIG. 7 is an explanatory view showing a relationship among the condensing pressure, the rotation number of the compressor, and the objective SC value.

In addition to a method of setting the objective SC value as shown in FIG. 4, FIG. 7 is an explanatory view showing a relationship among the condensing pressure, the rotation number of the compressor, and the objective SC value relative to the characteristics of the rotation number of the compressor 1 as shown in FIG. 6. In each of the zones of the condensing pressure in FIG. 4, the objective SC value is set so as to be stepwise increased, as the rotation number of the compressor is stepwise increased.

Specifically, in case where the condensing pressure is less than 3.00 MPaG during the rising tendency, or the condensing pressure is less than 2.80 MPaG during the dropping tendency, the objective SC values are respectively set to be 6° C., 10° C. and 12° C. in the respective zones where the rotation number is less than 40 rps, from 40 rps to 70 rps, and more than 70 rps, in order from the zone having the smaller pressure. In the other zones of the condensing pressure too, similar zones of the rotation numbers are formed, and the objective SC values are respectively set.

FIG. 10 is an objective SC table in which the objective SC values in FIG. 7 are itemized in the table to be applied to the actual control. In the objective SC table as shown in FIG. 10, a left column shows items, which are, from above to below, "state of condensing pressure", "threshold value of condensing pressure" (unit: MPaG), and "rotation number" (unit: rps). The "rotation number" is divided into three zones, specifically, more than 70 rps, from 40 rps to 70 rps, and less than 40 rps. The objective SC values in FIG. 10 are determined based on the values which have been obtained by experiments, and these determined values are stored in advance as the table.

The "state of condensing pressure" is for discriminating whether the condensing pressure is rising or dropping. Actually, whether it is rising or dropping is determined depending on whether the pressure values which have been intermittently detected by the pressure sensor 10 of the control means 7 has changed from below to above, or from above to below with respect to the threshold values.

Then, a method of controlling the SC value, using the objective SC table, will be described.

The control means 7 extracts the latest state of the condensing pressure as to whether it is rising or dropping, the condensing pressure from the latest detected value of the pressure sensor 10, and the latest rotation number of the compressor 1 respectively. Then, the control means 7 extracts the objective SC value described in the objective SC table, from the respective zones in the columns of the "state of the condensing pressure", "threshold value of the condensing pressure", and "rotation number" of the objective SC table.

Means for conducting a process for storing the objective SC table and extracting the objective SC value is the above described objective SC value extracting means 7*a*. The means for detecting rotation number of the compressor 1 is the compressor rotation number detecting means 7*b*. The detecting means 7*b* extracts the current rotation number which is stored and controlled in the data of the compressor 1 controlled by the control means 7.

Thereafter, the control means 7 calculates the current SC value using the SC value calculating means 14, compares the calculated SC value with the objective SC value which has been extracted, and adjusts the opening degree of the electronic expansion valve 4 based on a difference between them. For example, the SC value is calculated using the SC value calculating means 14, and obtained by deducting the temperature detected by the refrigerant temperature sensor 11 from the liquidizing temperature which is figured out from the current condensing pressure (discharging pressure) with respect to a saturated liquid line in a Mollier diagram of the refrigerant which is currently used.

The control means 7 deducts the objective SC value from the current SC value. When the result of this deduction is plus, the control means 7 controls the opening degree of the electronic expansion valve 4 so as to open the valve 4 according to a result value of this deduction, and when the result of this deduction is minus, the control means 7 controls the opening degree of the electronic expansion valve 4 so as to close the valve 4 according to the result value of this deduction. By controlling the opening degree in this manner, the apparatus is controlled so that the current SC value may always reach the objective SC value, and consequently, the COP is maintained at a high level.

As the actual control, the control means 7 rotates the compressor 1 so that the current temperature of the discharging hot water which is detected by the discharging hot water temperature sensor 12, that is, the temperature of the water which has been heated by the utilization-side heat exchanger 3 may reach the objective temperature of the discharging hot water which has been set in advance. On this occasion, the electronic expansion valve 4 is controlled so as to correspond to the rotation number of the compressor 1. On the other hand, adjustment of the electronic expansion valve 4 according to the exemplary embodiment is conducted by controlling the opening degree within a relatively small range. Specifically, relatively large control of the opening degree of the electronic expansion valve 4 corresponds to the rotation number of the compressor 1 which is determined by a difference between the current temperature and the objective temperature of the discharging hot water. The adjustment of the electronic expansion valve 4 according to the exemplary embodiment is conducted so as to correct the opening degree.

Figure 8:
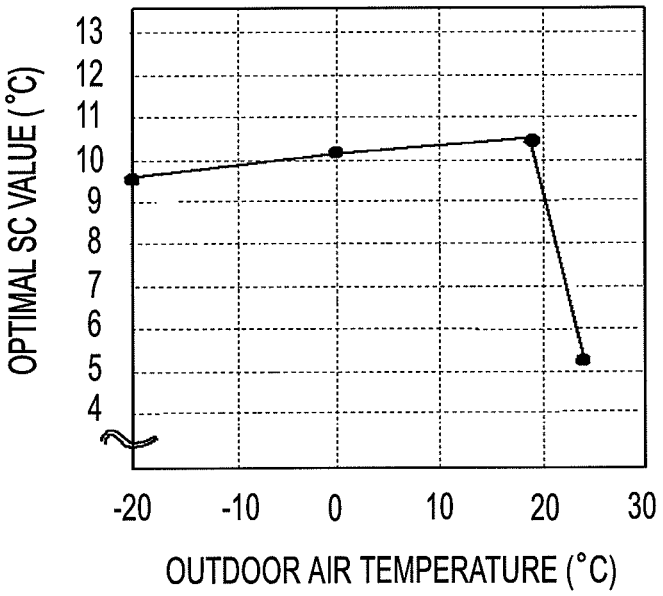
FIG. 8 is a graph showing a relationship between the optimal SC value and an outdoor air temperature.

Then, other characteristics will be described. FIG. 8 is a graph showing a relationship between the optimal SC value (unit: ° C.) which is shown on a Y-axis and an outdoor air temperature (° C.) which is shown on an X-axis. As shown in FIG. 8, when the outdoor air temperature exceeds 20° C., the optimal SC value tends to drop abruptly, and therefore, the values in the objective SC table in FIG. 10 may preferably be corrected. In this manner, the COP can be maintained at a relatively high level, even if the outdoor air temperature is high.

Figure 9:
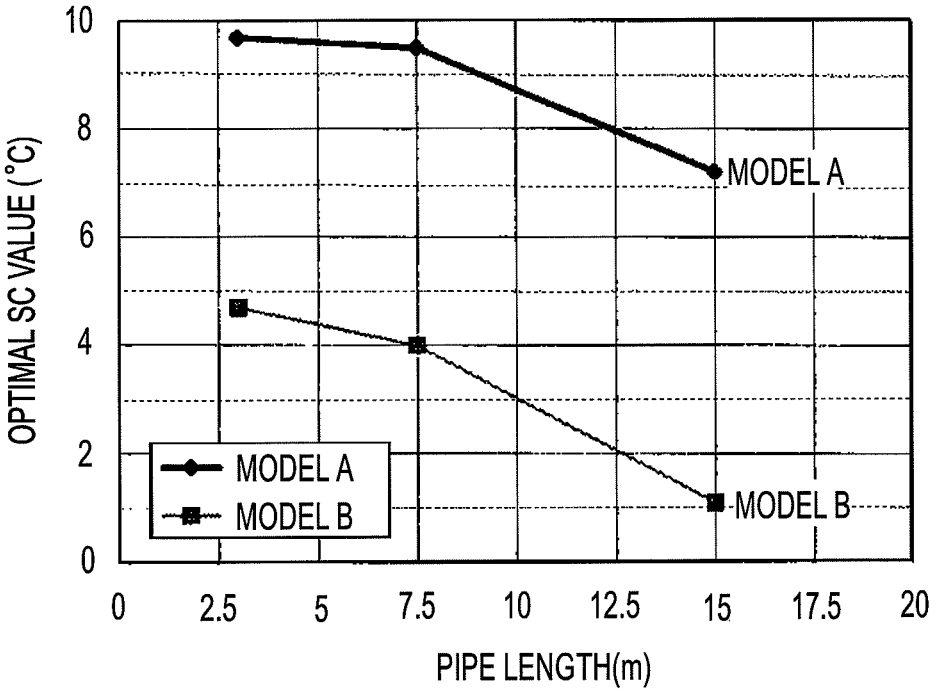
FIG. 9 is a graph showing a relationship between the optimal SC value and a pipe length.

FIG. 9 is a graph showing a relationship between the optimal SC value (unit: ° C.) which is shown on a Y-axis and a pipe length which is shown on an X-axis. The pipe length herein described is a length of a pipeline between the utilization-side heat exchanger 3 and the outdoor heat exchanger 5, that is, the length of the pipeline connecting an indoor apparatus to an outdoor apparatus, in case of an air conditioner, for example.

As shown in FIG. 9, two models of apparatuses having different abilities have substantially the same tendencies in the graph, although the particular optimal SC values are different to each other. The optimal SC values tend to drop, as the pipe length becomes longer. Therefore, after the heat pump type heater has been installed, data of the pipe length are preferably stored in the control means 7, and the values of the objective SC table in FIG. 10 are preferably corrected according to the pipe length. In this manner, the COP can be maintained at a high level, even if the pipe length has been varied according to conditions for installation.

On the other hand, in such an apparatus that the pipe length is set to be a standard length, and the control is effected by using the optimal SC value corresponding to the pipe length, because a circulating amount of the refrigerant is decreased, even if the pipe length is made longer for convenience of installing work, the control means 7 controls the electronic expansion valve 4 to open. In this case, the discharging pressure becomes extraordinarily high, but such inconvenience can be avoided according to the exemplary embodiment.

As described above, by delicately setting the objective SC value, considering not only the condensing pressure but also the rotation number of the compressor 1, it is possible to maintain the COP at a high level in the heat pump apparatus such as the heat pump type floor heater, the water heater, and so on.

Moreover, as shown in FIG. 10, the objective SC values which have been previously obtained by experiments are stored in the objective SC table in such a manner that the objective SC value is smaller as the condensing pressure of the compressor 1 increases, and the objective SC value is larger as the rotation number of the compressor 1 increases. Then, the values of the condensing pressure and the rotation number are controlled in the respective zones, and the objective SC values are stored in the respective combinations of the zones. Therefore, it is possible to extract the objective SC value according to both conditions of the values of the condensing pressure and the rotation number of the compressor 1.

Figure 11A:
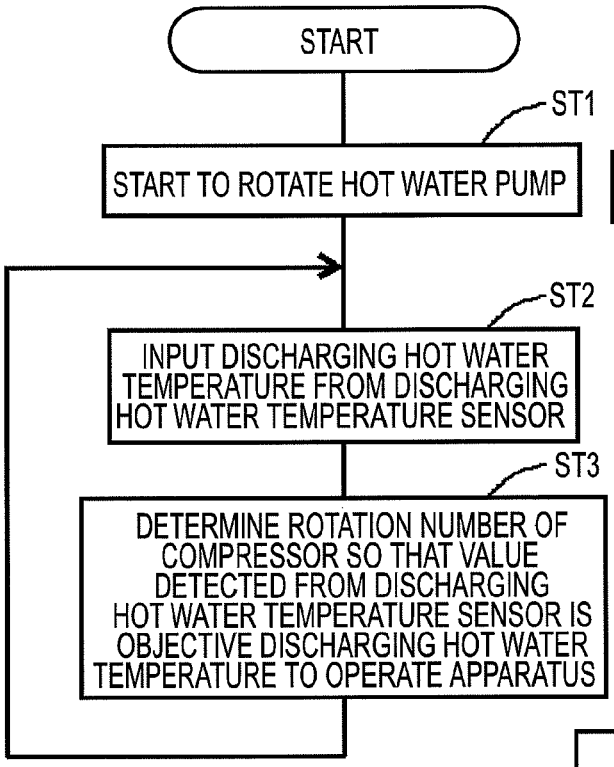
FIGS. 11A and 11B are flow charts showing control operation according to the invention.
Figure 11B:
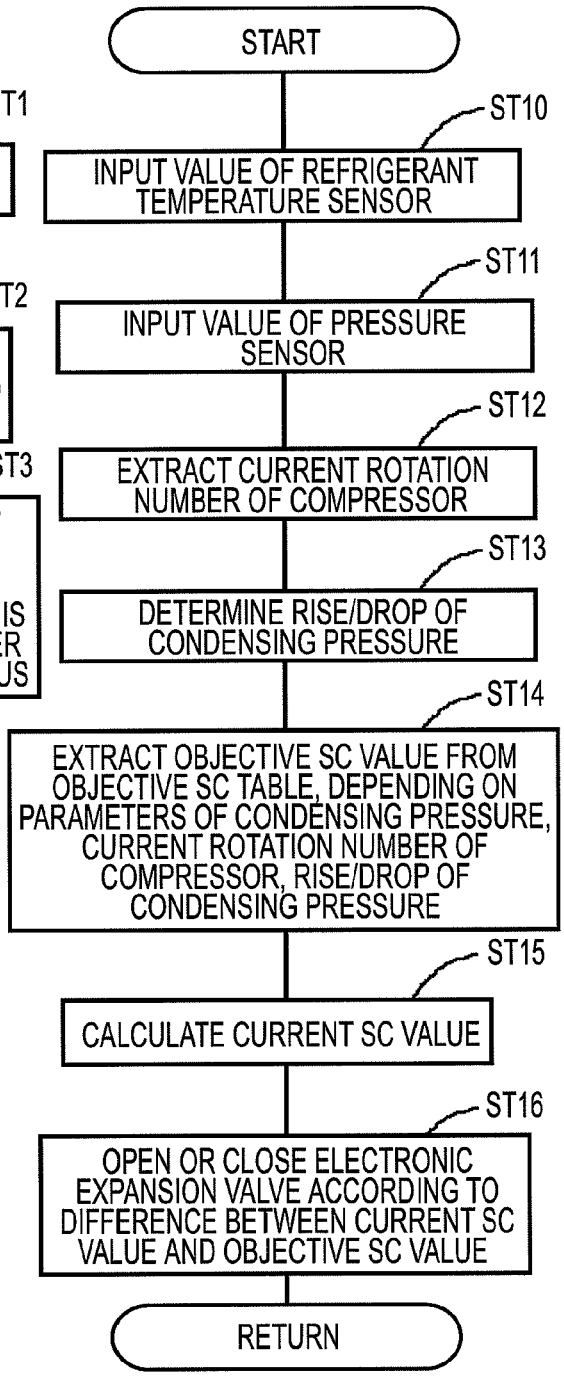

FIGS. 11A and 11B are flow charts showing processes in the control means 7 for controlling the heat pump type floor heater. FIG. 11A shows a main routine of the heat pump type floor heater, and FIG. 11B shows a SC value controlling routine according to the exemplary embodiment. The SC value controlling routine is operated in parallel with the main routine, and actuated at every fixed time by timer intrusion, so as to minutely adjust (correct) the opening degree of the electronic expansion valve 4 which has been controlled by the main routine.

In FIGS. 11A and 11B, ST represents a step, and a numeral following the ST represents a step number. In FIGS. 11A and 11B, the processes according to the exemplary embodiment will be mainly described, but description concerning general processes such as setting operation by a user, detailed control of the temperature of the discharging hot water will be omitted.

As shown in FIG. 11A, when the control means 7 starts to control, rotation of the hot water pump 9 is started, thereby to circulate water between the utilization-side heat exchanger 3 and the floor heating panel 8 (ST1). Then, the control means 7 inputs temperature of the water circulating from the discharging hot water temperature sensor 12, that is, the temperature of the discharging hot water (ST2). Then, the control means 7 determines the rotation number of the compressor 1 so that the value detected by the discharging hot water temperature sensor 12 may reach the discharging hot water temperature which has been set in advance, and rotates the compressor 1 thereby to operate the heat pump type floor heater (ST3). The opening degree of the electronic expansion valve 4 is roughly controlled by the rotation number of the compressor 1, as described above. Thereafter, jumping to ST2, the process will be repeated.

On the other hand, as shown in FIG. 11B, in parallel with the main routine which has been described above, the control means 7 inputs the temperature of the refrigerant just before the electronic expansion valve 4, from the refrigerant temperature sensor 11 (ST10). Then, the discharging pressure (condensing pressure) of the compressor 1 from the pressure sensor 10 is inputted (ST11). Then, the current rotation number of the compressor 1 is extracted (ST12). The control means 7 also controls the compressor 1 so that the current rotation number may reach the objective rotation number, and therefore, stores the current rotation number too. Herein, the current rotation number is extracted.

Then, the control means determines a rise or a drop of the condensing pressure by the compressor 1 (ST13) depending on whether the values of the pressure sensor 10 which have been taken periodically at a plurality of times become larger or become smaller in time series, as described above. Thereafter, using respective parameters of the condensing pressure, the rotation number of the compressor 1 and the rise or drop of the condensing pressure which have been obtained in ST11 to ST13, the objective SC value is extracted from the objective SC table which has been described in FIG. 10 (ST14).

Then, the current SC temperature is calculated from the refrigerant temperature which has been detected in ST10, and the discharging pressure of the compressor 1 which has been detected in ST11, that is, the condensing temperature (ST15). Thereafter, the opening degree of the electronic expansion valve 4 is minutely adjusted according to a difference between the objective SC value which has been extracted in ST14 and the current SC value which has been calculated in ST15 (ST16).

Specifically, the objective SC value is deducted from the current SC value, and the electronic expansion valve 4 is controlled to be opened, when the result of the deduction is plus, and controlled to be closed, when the result of the deduction is minus. Then, this process is finished.

Although the condensing pressure detecting means 13 is composed of the pressure sensor 10 and the control means 7 in the exemplary embodiment, the invention is not limited to such structure. Alternatively, it is possible to use the refrigerant temperature sensor in place of the pressure sensor 10, and to convert the refrigerant temperature into the refrigerant pressure by the control means 7. Moreover, although the control means 7 includes therein the compressor rotation number detecting means 7*b*, the invention is not limited to such structure. Alternatively, the rotation number may be directly obtained by using a rotary position sensor of a driving motor for the compressor 1. Further, although the SC value calculating means 14 is composed of the pressure sensor 10, the control means 7 and the refrigerant temperature sensor 11 in the exemplary embodiment, the invention is not limited to this structure. Alternatively, the SC value calculating means 14 may be composed of the condensing temperature sensor provided in the utilization-side heat exchanger 3, the control means 7, and the refrigerant temperature sensor 11.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A heat pump apparatus comprising:

a refrigerant circuit which includes a compressor, a utilization-side heat exchanger for exchanging heat between water and refrigerant, an electronic expansion valve, and an outdoor heat exchanger;

a controller which controls the compressor and the electronic expansion valve;

a subcooling value calculating unit which calculates a subcooling value of the refrigerant circuit;

a condensing pressure detector which detects condensing pressure of the compressor;

a compressor rotation number detector which detects rotation number of the compressor; and an objective subcooling value extracting unit which selects and extracts an objective subcooling value which corresponds to a high level coefficient of performance and which is stored in advance, from the condensing pressure and the rotation number of the compressor, wherein the controller adjusts an opening degree of the electronic expansion valve so that the calculated subcooling value of the refrigerant circuit reaches the objective subcooling value, wherein the objective subcooling value extracting unit stores a plurality of objective subcooling values which have been determined in advance, in respective zones of values of the condensing pressure and the rotation number of the compressor, and wherein a first zone of the zones of the values of the condensing pressure corresponds to increasing condensing pressure and uses a first threshold value of the condensing pressure to define the first zone, and wherein a second zone of the zones of the values of the condensing pressure corresponds to decreasing condensing pressure and uses a second threshold value of the condensing pressure which is different from the first threshold value to define the second zone.

2. The heat pump apparatus according to claim 1, wherein each of the stored objective subcooling values becomes smaller as the condensing pressure becomes higher, and becomes larger as the rotation number becomes larger.

* * * * *